US006101667A

United States Patent [19]

Ishikawa

[11] Patent Number: 6,101,667

[45] Date of Patent: Aug. 15, 2000

[54] VACUUM CLEANER

[75] Inventor: Masahiro Ishikawa, Kyoto, Japan

[73] Assignee: Yashima Electric Co., Ltd., Kyota, Japan

[21] Appl. No.: 09/145,300

[22] Filed: Sep. 2, 1998

[30] Foreign Application Priority Data

Sep. 3, 1997 [JP] Japan ..... 9-237909

[51] Int. Cl.[7] ..... A47L 9/28

[52] U.S. Cl. ..... 15/319; 15/339

[58] Field of Search ..... 15/319, 339, 412

[56] References Cited

U.S. PATENT DOCUMENTS

| | | | |
|---|---|---|---|
| 4,370,776 | 2/1983 | Kullik | 15/319 |
| 4,399,585 | 8/1983 | Kullik et al. | 15/319 |
| 4,514,874 | 5/1985 | Kurz . | |
| 5,033,151 | 7/1991 | Kraft et al. | 15/339 X |
| 5,404,612 | 4/1995 | Ishikawa | 15/339 X |
| 5,572,767 | 11/1996 | Ishikawa | 15/339 X |

FOREIGN PATENT DOCUMENTS

| | | |
|---|---|---|
| 0 636 339 | 2/1995 | European Pat. Off. . |
| 20 17 107 | 10/1971 | Germany . |
| 32 25 463 A1 | 1/1984 | Germany . |
| 2 082 351 | 3/1982 | United Kingdom . |

*Primary Examiner*—Chris K. Moore
*Attorney, Agent, or Firm*—Smith Gambrell & Russell, LLP

[57] ABSTRACT

A vacuum cleaner includes an automated air quantity adjusting mechanism which has good linearity and has no hysteresis. The automated air quantity adjusting mechanism includes an exhaust opening section 7*a* formed within a cylindrical body 7. A flange 26 provides the exhaust opening section 7*a* at the lower section of a supporting body 6 which supports an electric generator 9. A guide shaft 21 is provided at a central section of the exhaust opening section 7*a* in a standing manner which guide shaft has a stopper member 24 at its uppermost edge section. The mechanism further includes a circular plate shaped valve 22 in which the guide shaft 21 is passed therethrough, and a returning coil spring 25 for pushing the valve 22 towards the stopper 24. The valve 22 is moved downward by negative pressure within an air suction passage 2 so that a distance between the valve 22 and the exhaust opening section 7*a* is changed and an air quantity flowing towards the air suction passage 2 through the exhaust opening section 7*a* is adjusted.

3 Claims, 7 Drawing Sheets

Fig. 2
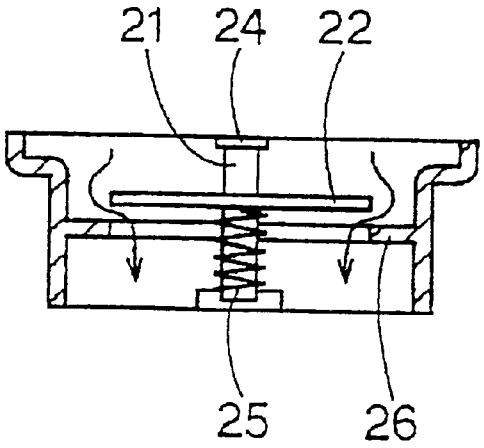
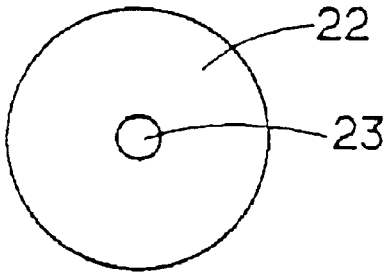
Fig. 3(a)
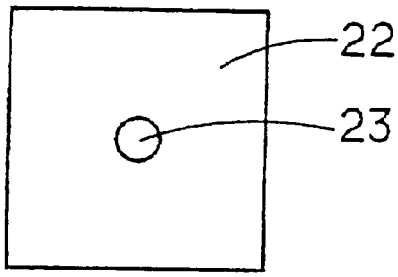
Fig. 3(b)

VACUUM CLEANER

BACKGROUND OF THE INVENTION

The present invention relates to a vacuum cleaner. More particularly, the present invention relates to a vacuum cleaner having an electric generator which generates an electric voltage due to a negative pressure which is generated by air suction for sucking dust into the vacuum cleaner.

RELATED ART

The inventor has developed a vacuum cleaner. The vacuum cleaner is illustrated in FIGS. 6 and 7 and operates as follows. When the vacuum cleaner sucks dust particles, outside air is sucked therein by a suction force through a suction hole 3 of an operation section 1 and a suction hole 6*a* of a supporting body 6 for supporting an electric generator 9. A turbine impeller 8 is rotated by the suction air. A rotor of the electric generator 9 is rotated following the rotation of the turbine impeller 8 so that the electric generator 9 generates a voltage. The generated voltage is used as a power voltage of a dust sensor and the like.

When the electric generator is driven using the turbine impeller, a difference pressure (a negative pressure) between a suction pressure and a pressure at an outside air inlet section varies greatly, i.e. within an extent of about 490 hpa (hecto-pascal)—about 24,500 hpa, depending upon a condition during a cleaning operation. Therefore, the vacuum cleaner includes a butterfly valve 10 within a suction passage 12 which is formed between the turbine impeller 8 and the suction passage 2. The vacuum cleaner also includes an automated air quantity adjusting mechanism 5 which maintains an air quantity flowing into the turbine impeller 8 to be a constant quantity despite variation of the negative pressure, so that a constant generated voltage is obtained by the electric generator 9. A reference numeral 11 represents a twisted spring for returning the butterfly valve 10. The butterfly valve 10 is included within the automated air quantity adjusting mechanism 5.

In the automated air quantity adjusting mechanism 5, when suction is started, air flows from the suction hole 3 to an opening 7*a* corresponding to the suction passage 2 of a pipe 7 which is provided at a lower position of the supporting body 6 through the suction hole 6*a* of the supporting body 6 and the suction passage 12. The turbine impeller 8 rotates due to a force of suction air, and the electric generator 9 rotates accordingly so that a voltage is generated. When the air quantity is small, the butterfly valve 10 is inclined by a small angle with respect to a vertical posture. When the air quantity is increased, a rotation force in a direction illustrated by an arrow is generated at an upper half section 10*a* of the butterfly valve 10 so that the butterfly valve 10 rotates to a more horizontal posture from the vertical posture. As a result, an effective opening area of the opening 7*a* decreases and the air quantity is prevented from increasing so that a rotation speed of the turbine impeller 8 is suppressed to some degree and an increase in voltage generated by the electric generator 9 is also suppressed to some degree.

When the negative pressure is increased and the air quantity is going to increase greatly, the butterfly valve 10 receives great pressures at the upper half section 10*a* and a lower half section 10*b*. The rotation force is stronger than the returning force of the twisted spring 11 (valve returning spring having a coiled spring shape) and the butterfly valve 10 rotates further in the direction illustrated by the arrow. The butterfly valve 10 stops its rotation at a condition in which the butterfly valve 10 is rotated to represent a posture of Japanese character "^" Therefore, the effective cross-sectional area of the opening 7*a* is almost closed and the air quantity passing through the opening 7*a* is limited and suppressed greatly.

When the automated air quantity adjusting mechanism including the butterfly valve is employed, the generated voltage is maintained to be an almost constant voltage. But, turbulence is difficult to prevent from occurring. A hysteresis characteristic is generated between an operation in which the negative pressure is increased and an operation in which the negative pressure is decreased, accordingly (refer to FIG. 8). There are difficult points when the generated voltage is used to detect the negative pressure, for example.

Further, the butterfly valve is supported rotatably within the suction passage 12 using a supporting shaft. A disadvantage arises in that high accuracy is required in a distance of the supporting shaft and a distance between both bearings provided at the suction passage, that is, the mechanical design arrangement is required to have extremely high accuracy. Another disadvantage arises in that a cost of the elements and a cost for assembling and adjusting are expensive.

The present invention was made in view of the above problems.

It is an object of the present invention to offer a vacuum cleaner including an air quantity adjusting function which represents a high linearity, represents no hysteresis, has a simple arrangement in elements, is cheap, and is easy in arranging and adjusting.

SUMMARY OF THE INVENTION

A vacuum cleaner according to the present invention comprises, a dust suction passage for sucking dust and air, an air suction passage having one end which is connected to the dust suction passage and another end which is opened to outside air, an impeller provided within the air suction passage, the impeller being rotated by a suction force within the air suction passage, an electric generator rotated by a rotation force of the impeller, the electric generator generating a voltage, and an air quantity adjusting valve for adjusting air quantity in response to a pressure of air flowing within the air suction passage, the air quantity adjusting valve being provided within the air suction passage, wherein the air quantity adjusting valve includes, a guide shaft provided at a central section of an opening section of the air suction passage for placing the air suction passage and the dust suction passage in communication, a circular valve body which moves along the guide shaft in a slidable manner in response to negative pressure within the air suction passage, and a coil spring for energizing the circular valve body in a direction which is opposite to a circular valve body moving direction due to the negative pressure.

When the vacuum cleaner having the above arrangement is employed, the air suction quantity through an air suction hole in response to a condition that the negative pressure within the air suction passage is small. Therefore, the circular valve body is positioned at an upper position of the guide shaft so that a large quantity of air can flow from the air suction passage to the dust suction passage through the opening section. The circular valve body is pushed downward and is moved downward along the guide shaft, when the negative pressure within the air suction passage is great. When the circular valve body approaches the opening section of the air suction passage for placing the air suction passage and the dust suction passage in communication, an effective opening area of the opening section becomes small so that a quantity of air which flows into the dust suction passage is small.

BRIEF DESCRIPTION OF THE DRAWINGS

FIG. 2 is a cross-section view of an air quantity valve, which is useful in understanding a condition when a difference pressure between a dust suction passage and out side air is great;

FIG. 3(*a*) is a plan view of an air quantity valve body;

FIG. 3(*b*) is a plan view of another air quantity valve body;

DETAILED DESCRIPTION OF PREFERRED EMBODIMENTS

Hereinafter, referring to the attached drawings, we explain embodiments according to the present invention in detail.

Figure 1:
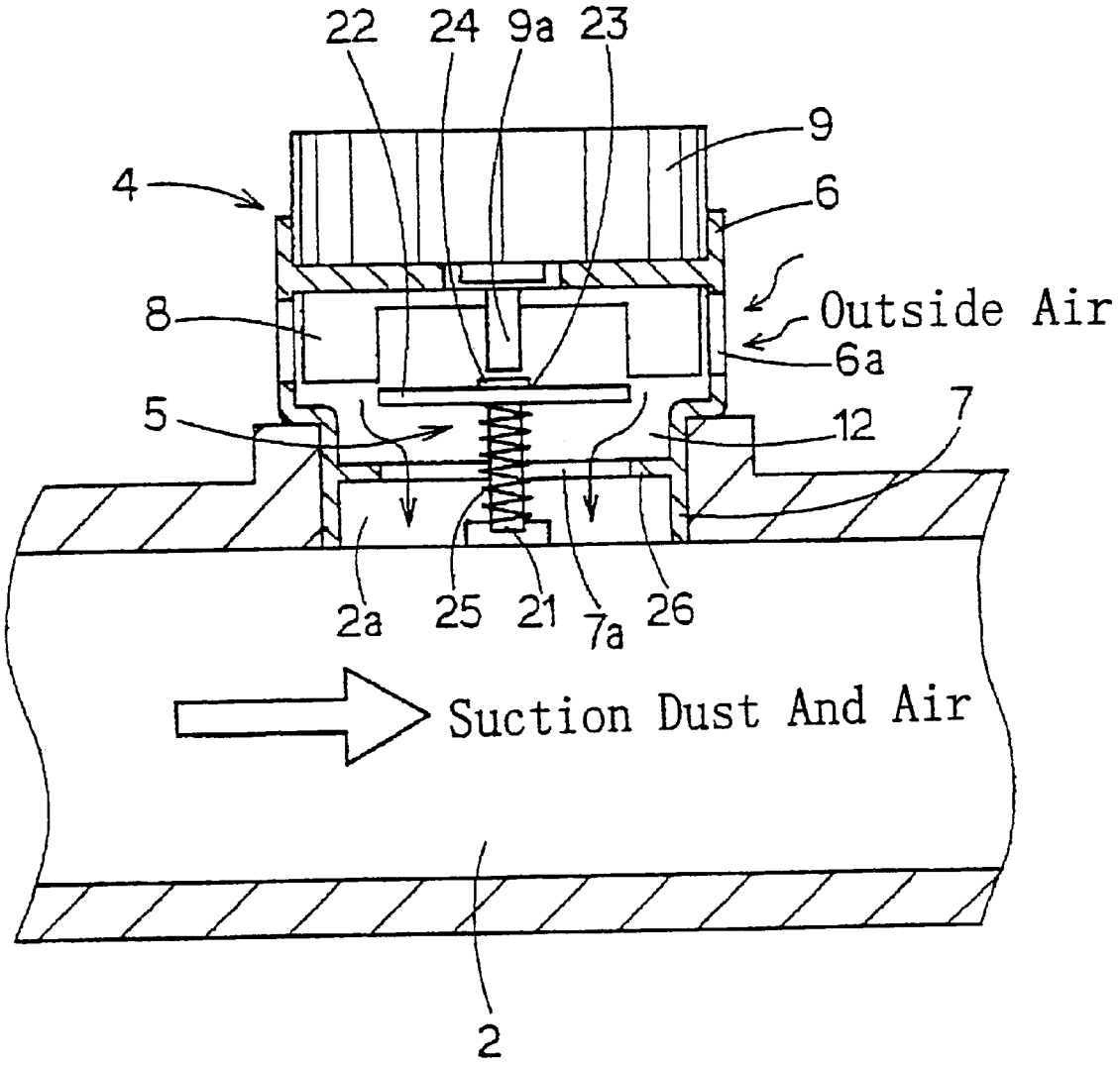
FIG. 1 is a cross-section view of a main portion of a vacuum cleaner of an embodiment according to the present invention.
Figure 4A:
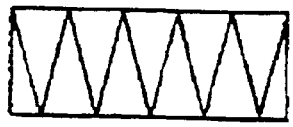
FIGS. 4(*a*)–4(*b*) are diagrams, each represents an arrangement of a coil spring.
Figure 4B:
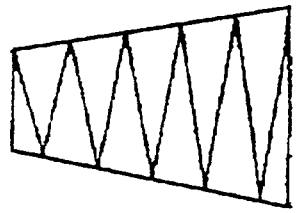
Figure 4C:
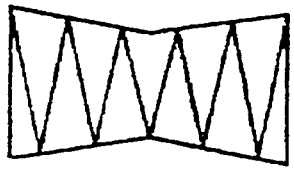
Figure 4D:
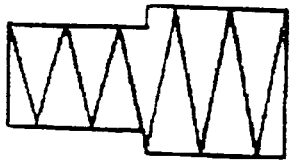

FIG. 1 is a cross-section view of a main portion of a vacuum cleaner of an embodiment according to the present invention.

Figure 6:
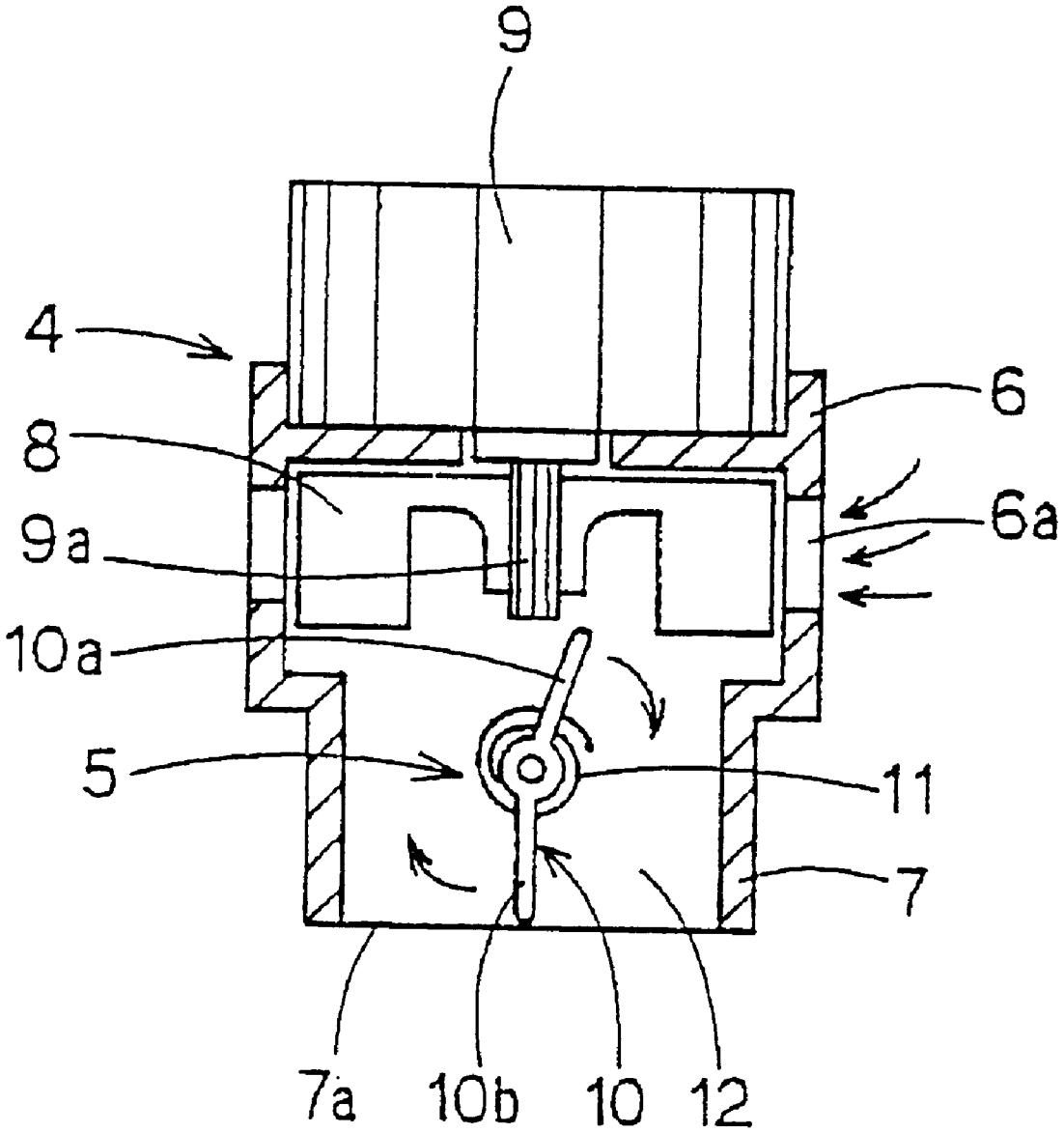
FIG. 6 is a cross-section view of a main portion of a conventional vacuum cleaner.
Figure 7:
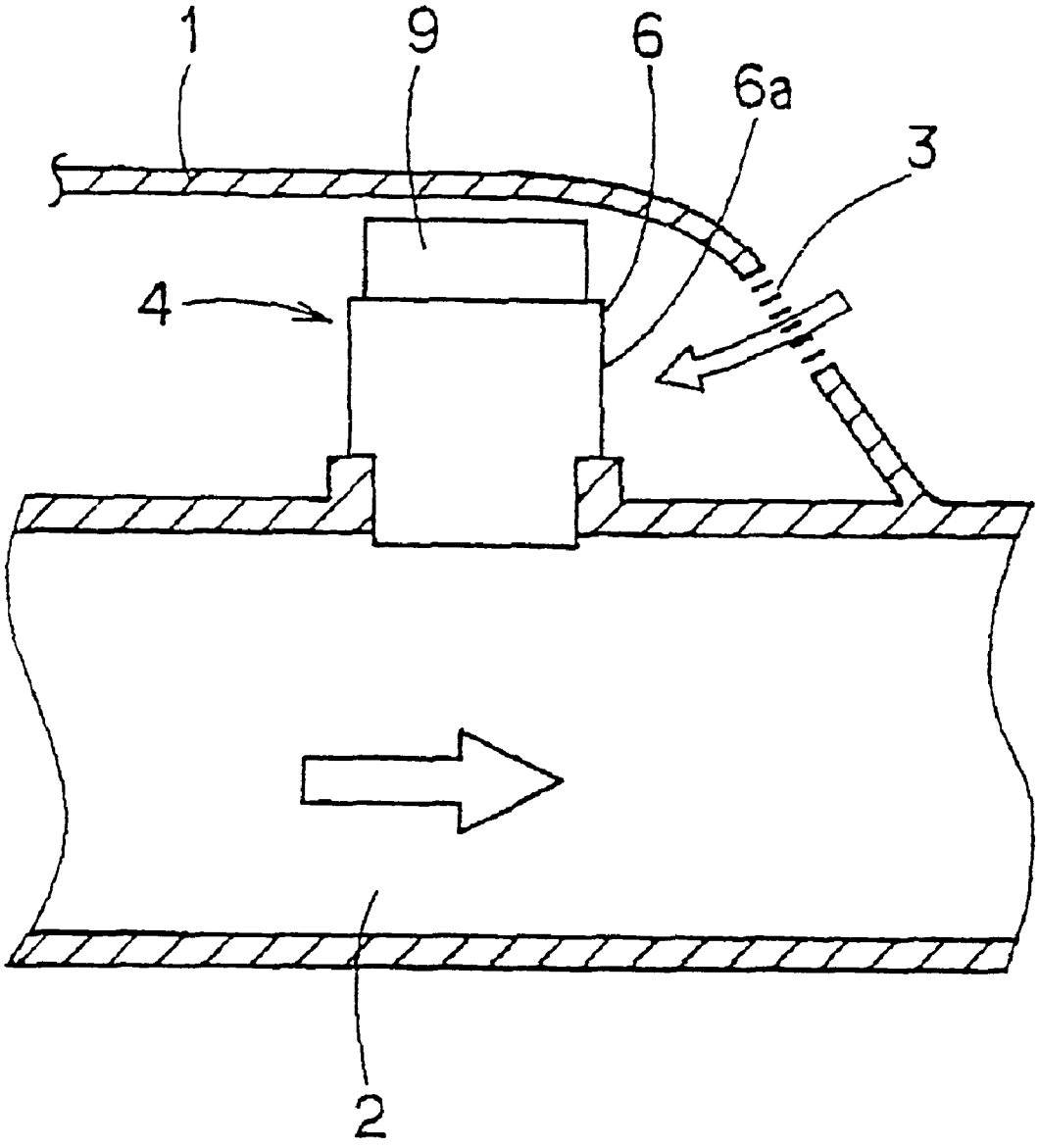
FIG. 7 is a diagram useful in understanding deposition arrangement of an electric generator and an automated air quantity adjusting mechanism.
Figure 8:
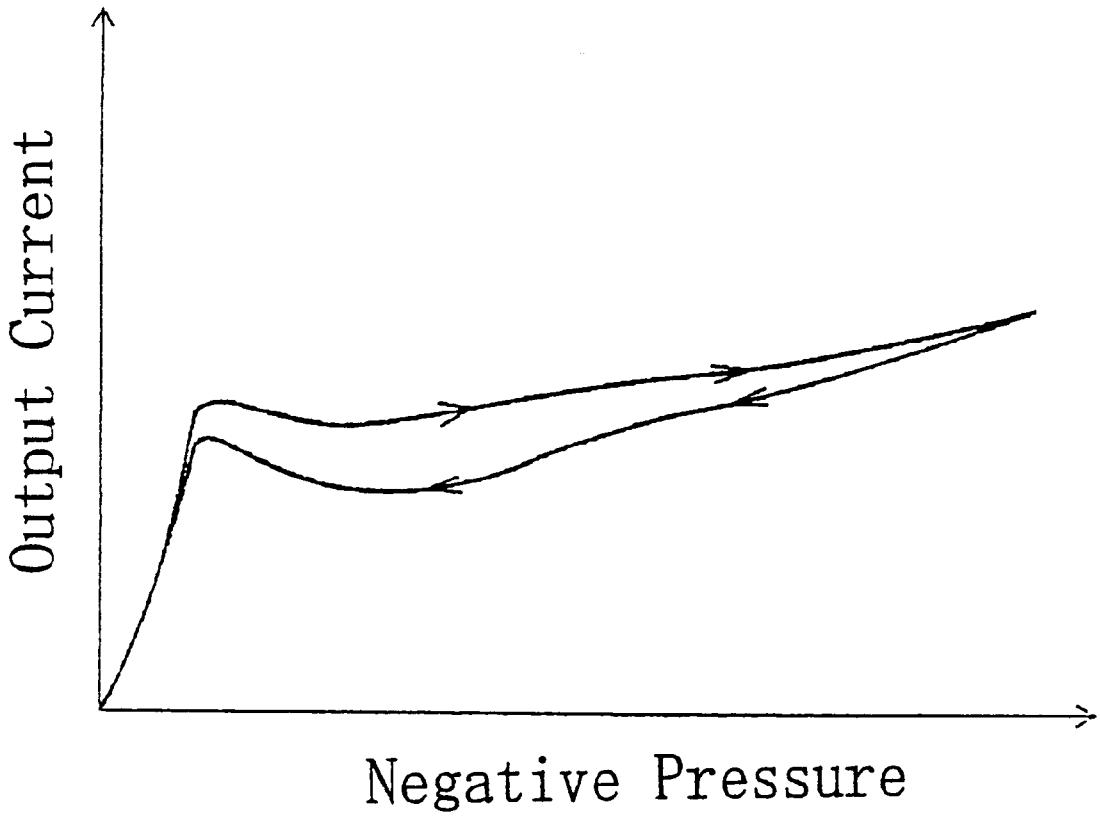
FIG. 8 is a diagram useful in understanding a negative pressure—output current characteristic of a conventional vacuum cleaner.

In this vacuum cleaner, a cylindrical section 7 of a supporting body 6 of an electric generator 9 is provided at an opening section 2*a* of a dust suction passage 2. The dust suction passage 2 communicates with an automated air quantity adjusting mechanism 5 through the opening section 2*a*. An exhaust opening section 7*a* communicates with the opening section 2*a*. And, a turbine impeller 8 is rotated by suction air which is sucked through an air suction hole 6*a*. A rotor of the electric generator 9 is rotated in response to the rotation of the turbine impeller 8 so that the electric generator 9 generates a voltage. The above arrangement is the same as the arrangement illustrated in FIG. 6. Further, the electric generator 9 and the like are provided at an operation section 1 which has an air suction hole 3 which is similar to that illustrated in FIG. 7. Furthermore, as is well known, the dust suction passage 2 is connected by its left side to a dust suction nozzle and is connected by its right side to a main body section of a vacuum cleaner which includes therein a motor, dust bag and the like.

The vacuum cleaner of this embodiment according to the present invention is characterized in the following arrangement.

The automated air quantity adjusting mechanism 5 includes, as is illustrated in FIG. 1, a guide shaft 21 which is provided in a standing manner at a central section of the exhaust opening section 7*a* of the cylindrical section 7 which corresponds to the opening section 2*a* of the dust suction passage 2, a valve 22 having a circular plate shape and a small hole 23 for passing the guide shaft 21 therethrough, and a returning coil spring 25. The returning coil spring 25 is passed through by the guide shaft 21. The returning coil spring 25 pushes the valve 22 by the returning force which works in a direction reverse to the negative pressure working direction, so as to contact the valve 22 to a stopper 24 which is provided at a leading edge section of the guide shaft 21. Further, the exhaust opening section 7*a* is determined to have a smaller diameter than the inner diameter of the cylindrical section 7 by providing a flange 26. Of course, the flange 26 may be omitted.

When the vacuum cleaner is in an operating condition, outside air is sucked through the opening section 6*a* which is formed at a portion of a pinwheel-generating section 4 based upon a difference in pressure between the interior and the exterior of the dust suction passage 2. The sucked air rotates the turbine impeller 8. Then, the sucked air flows to the dust suction passage 2 through a gap portion between the exhaust opening section 7*a* and the peripheral section of the valve 22, and the opening section 2*a*. The valve 22 has the small hole 23 for passing the guide shaft 21 therethrough and has a circular shape, as is illustrated in FIG. 3(*a*). But, the valve 22 may have another shape such as a rectangular shape or the like so as to suit an inner cross sectional shape of the cylindrical section 7, as is illustrated in FIG. 3(*b*).

When the difference in pressure (negative pressure) between the interior of the dust suction passage 2 and the outside air is small, a pressing force applied to the top face of the valve 22 having the circular shape is also small. The valve 22 is maintained in its condition by the returning coil spring 25 so that the valve 22 is pressed and contacted to the stopper 24 which is provided at the uppermost section of the guide shaft 21. Therefore, a large quantity of air can flow through the exhaust opening section 7*a* which is communicated to the dust suction passage 2.

When the difference in pressure (negative pressure) between the interior of the dust suction passage 2 and the outside air is increased little by little, the pressing force applied to the top face of the valve 22 is also increased little by little. Then, the valve 22 moves downward to a position so that the returning force of the returning coil spring 25 and the pressing force balance one another. Therefore, the gap section between the valve 22 and the flange 26 becomes smaller so that the valve 22 prevents the air flow towards the dust suction passage 2 to some degree.

When the difference in pressure (negative pressure) between the interior of the dust suction passage 2 and the outside air is increased more, the valve 22 is moved downward more. That is, the valve 22 approaches the opening section 2*a* formed at the bottom side of the exhaust opening section 7*a* so that the effective opening area thereof is decreased. Therefore, the valve 22 operates so that it is difficult for a large quantity of air to flow towards the dust suction passage 2 (refer to FIG. 2).

As is apparent from the foregoing, the automated air quantity adjusting mechanism is realized which performs the following operation. When the negative pressure is small, a large quantity of air easily flows towards the dust suction passage 2. And, the quantity of air flowing to the dust suction passage 2 is limited or decreased following the increase in the negative pressure.

Figure 5:
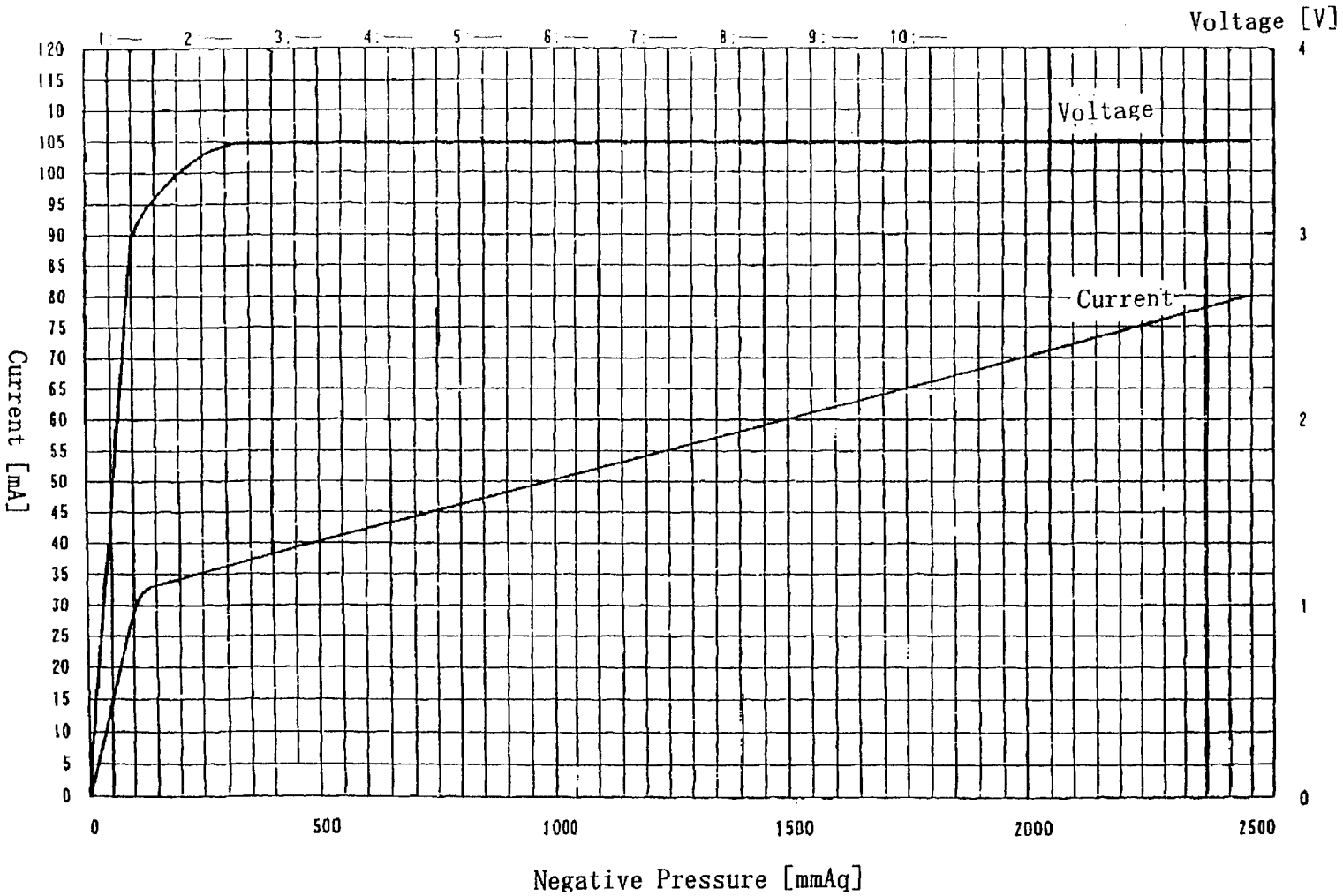
FIG. 5 is a diagram useful in understanding a negative pressure—output current (output voltage) characteristic.

When the vacuum cleaner is employed, it is confirmed that no hysteresis was generated in the relationship between the negative pressure and the output current (output voltage), as is illustrated in FIG. 5.

The returning coil spring 25 has a form of a compressed spring. Therefore, no hysteresis is realized in its pressure variation. The returning coil spring 25 may be a basic cylindrical shaped spring, as is illustrated in FIG. 4(*a*). The returning coil spring 25 may be a cone shaped spring {refer to FIG. 4(*b*)}, a hand drum shaped spring {refer to FIG. 4(*c*)}, a spring having different diameters {refer to FIG. 4(*d*)}, or the like. The spring characteristic of the returning coil spring may be determined to be a linear characteristic or an arbitrary characteristic by determining the diameter of the returning coil spring 25. Therefore, it is easy to determine the relationship between the negative pressure and the quantity of air flowing towards the dust suction passage 2 (in other words, the relationship between the negative pressure and the voltage generated by the electric generator 9).

In the vacuum cleaner, the valve 22 of the automated air quantity adjusting mechanism is determined to be a circular shape or equilateral polygon and is formed with the small hole 23 at the center for passing the guide shaft 21 therethrough. That is, the valve 22 has symmetry shapes in the outer shape, the shape of the small hole and the like. Therefore, the valve 22 is easily formed with high accuracy.

What is claimed is:

1. A vacuum cleaner comprising:

a dust suction passage for sucking dust and air;

an air suction passage having one end which is connected to the dust suction passage and another end which is open to an outside air;

an impeller within the air suction passage, wherein the impeller is rotated by a suction force within the air suction passage;

an electric generator rotated by a rotation force of the impeller, the electric generator generating a voltage; and an air quantity adjusting valve for adjusting air quantity in response to an air pressure differential between the interior and exterior of the dust suction passage, wherein the air quantity adjusting valve is within the air suction passage, and wherein the air quantity adjusting valve includes (a) a guide shaft provided at a central section of an opening section of the air suction passage for placing the air suction passage and the dust suction passage in communication;

(b) a valve body which moves along the guide shaft in a slidable manner in response to negative pressure within the air suction passage; and (c) a coil spring for pushing the valve body in a direction which is opposite to the direction the valve body moves due to the negative pressure, wherein the coil spring has a plurality of windings, some windings having a diameter which is different from a diameter of other windings.

2. A valve body as in claim 1, wherein in the valve body is circular.

3. A valve body as in claim 1, wherein the valve body is an equilateral polygon.

* * * * *